US010828662B2

(12) United States Patent
Wolf et al.

(10) Patent No.: US 10,828,662 B2
(45) Date of Patent: Nov. 10, 2020

(54) APPLICATOR FOR APPLYING A SEALING MASS

(71) Applicant: Henkel AG & Co. KGaA, Duesseldorf (DE)

(72) Inventors: Karsten Wolf, Duesseldorf (DE); Kai Ruthe-Steinsiek, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 199 days.

(21) Appl. No.: 15/729,083

(22) Filed: Oct. 10, 2017

(65) Prior Publication Data

US 2018/0029069 A1 Feb. 1, 2018

Related U.S. Application Data

(63) Continuation of application No. PCT/EP2016/058259, filed on Apr. 14, 2016.

(30) Foreign Application Priority Data

Apr. 14, 2015 (DE) ..... 10 2015 206 652

(51) Int. Cl.
*B05C 17/10* (2006.01)
*E04F 21/165* (2006.01)
(Continued)

(52) U.S. Cl.
CPC ..... *B05C 17/10* (2013.01); *B05C 17/00516* (2013.01); *E04F 21/165* (2013.01); *E04F 21/1652* (2013.01); *E04B 1/6801* (2013.01)

(58) Field of Classification Search
CPC .. B05C 17/10; B05C 17/00516; E04F 21/165; E04F 21/1652; E04B 1/6801
See application file for complete search history.

(56) References Cited

U.S. PATENT DOCUMENTS 5,017,113 A 5/1991 Heaton et al.
5,250,145 A * 10/1993 Despins ..... A47G 27/0487 156/304.1
(Continued)

FOREIGN PATENT DOCUMENTS

CN 2503182 Y 7/2002
CN 1431937 A 7/2003
(Continued)

OTHER PUBLICATIONS

International Search Report for International PCT Patent Application No. PCT/EP2016/058259 dated Jul. 13, 2016.

*Primary Examiner* — Nahida Sultana
(74) *Attorney, Agent, or Firm* — James E. Piotrowski

(57) ABSTRACT

An applicator (200) having a feed opening (202) and a dispensing opening (201) situated opposite from the feed opening (202) for applying a sealing compound to a substrate, wherein the applicator (200) has a protruding blade (212) for smoothing the applied sealing compound, the blade (212) has a top side (228) and a bottom side (229), the bottom side (229) being situated adjacent to the dispensing opening (201), and the blade (212) has a right blade section (209) and a left blade section (210) situated opposite from the right blade section (209), the right blade section (209) and the left blade section (210) protruding laterally, and the blade (212) also having a front blade section (211) that protrudes in the distal direction, and the blade sections (209, 210, 218) being beveled in such a way that a right outer edge (220) is provided on the right blade section (209), a left outer edge (221) is provided on the left blade section (210), and a front outer edge (218) that joins the right outer edge (220) and the left outer edge (221) is provided on the front blade section (218), wherein the outer edges (220, 221, 218) lie in the plane of the bottom side (229), and the dispensing
(Continued)

opening (201) is situated at a distance from the front outer edge (218).

11 Claims, 5 Drawing Sheets

(51) Int. Cl.
*B05C 17/005* (2006.01)
*E04B 1/68* (2006.01)

(56) References Cited

U.S. PATENT DOCUMENTS

| | | | | |
|---|---|---|---|---|
| 5,622,728 | A * | 4/1997 | Kartler | B05C 17/00516 425/458 |
| 6,219,878 | B1 | 4/2001 | Dewberry | |
| 6,349,857 | B1 | 2/2002 | Lepsius et al. | |
| 6,926,177 | B1 | 8/2005 | Scott et al. | |
| 7,695,210 | B1 * | 4/2010 | Martinez | B05C 17/00503 401/193 |
| 9,259,757 | B1 * | 2/2016 | Santarsiero | B05C 17/0052 |
| 2001/0030207 | A1 * | 10/2001 | Wemyss | B05C 17/00596 222/567 |
| 2003/0192142 | A1 | 10/2003 | Veith | |
| 2010/0278958 | A1 | 11/2010 | Chamberlain et al. | |
| 2013/0207348 | A1 * | 8/2013 | Smeets | B05C 17/00516 277/316 |
| 2014/0212200 | A1 * | 7/2014 | Liao | B05C 17/00516 401/266 |
| 2017/0008024 | A1 * | 1/2017 | Weinmann | B05C 5/0208 |
| 2017/0021379 | A1 * | 1/2017 | Evans | B05C 17/0146 |
| 2017/0100740 | A1 * | 4/2017 | Pentland | B05C 17/01 |

FOREIGN PATENT DOCUMENTS

| | | | |
|---|---|---|---|
| DE | 1817180 | A1 | 7/1970 |
| DE | 19646352 | A1 | 5/1998 |
| DE | 29901981 | U1 | 5/1999 |
| DE | 19847514 | A1 | 5/2000 |
| DE | 10154442 | A1 | 5/2003 |
| DE | 10334167 | A1 | 3/2005 |
| DE | 202008014930 | U1 | 2/2009 |
| DE | 102013102021 | A1 | 8/2014 |
| GB | 2127283 | A | 4/1984 |
| JP | 2008261140 | A | 10/2008 |
| WO | 0020124 | A1 | 4/2000 |
| WO | 2007133096 | A2 | 11/2007 |
| WO | 2008017330 | A1 | 2/2008 |
| WO | 2012150471 | A1 | 11/2012 |

* cited by examiner

Section A - A

Section B - B

Section C - C

Section B - B

APPLICATOR FOR APPLYING A SEALING MASS

The invention relates to an applicator for applying a sealing compound, and an application device having a corresponding applicator and a container, for applying a sealing compound. The invention further relates to a method for applying a sealing compound, using such an applicator or such an application device.

These types of applicators or application devices with applicators are known in the prior art as application tools, and are used, for example, in industry, handicrafts, or the do-it-yourself sector. By use of such applicators, for example sealing compounds may be dispensed for sealing joints between components in the sanitary sector. These types of sealing compounds for sealing joints between components are widely used in particular where on the one hand a seal that is impermeable to air and moisture is required between the components, but on the other hand the components must have a certain movability relative to one another. This is necessary in particular when stresses occur in the joint due to varying mechanical load, or as the result of the diversity of the two materials, having different thermal expansion coefficients, that abut at the joint.

One known application tool is disclosed in WO 2008/017330 A1, for example. The invention described therein relates to a cartridge gun having a receiving unit for a cartridge that is filled with the product to be dispensed, a dosing unit for the product to be dispensed, and a handle. The cartridge gun is used in particular for silicone joints in the sanitary sector. An alternative cartridge gun is also disclosed in WO 2000/20124 A1.

Various auxiliary means are known in the prior art as aids for smoothing the sealing compound. For example, DE 202008014930 A1 discloses a joint smoother made up of multiple spatulas, having different radii, that are connected so as to be rotatable by 360 degrees on one side. A similar tool with regard to use is also disclosed in DE 19847514 A1. Furthermore, DE 10154442 A1 discloses an arrangement comprising a cartridge, a tool for subsequently treating joints with permanently elastic joint compound, and an attached application nozzle, the tool being connectable to the cartridge in a form-fit manner.

In addition, there are various application nozzles for cartridges containing the sealing compounds. Thus, for example, WO 2007/133096 A2 discloses a nozzle for installation on a cartridge, having a dispensing opening for dispensing a sealing compound, and a delta-shaped blade section for treating the dispensed sealing compound. Furthermore, DE 29901981 U1, US 2010/0278958 A1, DE 19646352 A2, DE 10334167 A1, and WO 2012/150471 A1 disclose similar tools for handling sealing compounds.

The object of the invention is to provide an improved applicator for applying a sealing compound, and an application device that has such an applicator.

With regard to the applicator, this object is achieved by the features of claim 1. Advantageous refinements are set forth in the dependent claims. With regard to the application device, this object is achieved by the features of claim 8.

The basic concept of the invention is to provide an applicator having a feed opening and a dispensing opening situated opposite from the feed opening for applying a sealing compound to a substrate. The feed opening is preferably provided on a proximal side of the applicator, and the dispensing opening is provided on an oppositely situated distal side. According to the invention, the applicator has a protruding blade for smoothing the applied sealing compound, the blade also preferably having a planar top side and a preferably likewise planar bottom side, and the bottom side being situated adjacent to the dispensing opening. The dispensing opening preferably adjoins, essentially directly, the surface of the bottom side. The applicator preferably also has a feed channel that opens into the dispensing opening, the channel preferably extending essentially parallel to the plane of the bottom side. According to the invention, it is also provided that the blade has a right blade section and a left blade section situated opposite from the right blade section, the right blade section and the left blade section protruding laterally, and the blade also having a front blade section, protruding in a distal direction, that joins the right blade section and the left blade section. Moreover, it is provided according to the invention that the blade sections are preferably beveled on their outer sides, at least in areas, in such a way that a right outer edge is provided on the right blade section, a left outer edge is provided on the left blade section, and a front outer edge that joins the right outer edge and the left outer edge is provided on the front blade section, the outer edges lying in the plane of the bottom side, and the dispensing opening preferably being situated at a distance from the front outer edge in the longitudinal extension of the applicator. Accordingly, it is provided according to the invention that the dispensing opening is recessed with respect to the front outer edge in the proximal direction or in the direction of the proximal side.

The bottom side of the applicator preferably faces the substrate in the application position of the applicator. Also advantageous are a design of the blade and a selection of an appropriate substrate, and guiding of the applicator in such a way that the outer edges of the left and the right blade sections are each guided along a surface region of the substrate.

Applying a sealing compound is particularly simple with such an applicator. An advantageous option for dispensing the sealing compound may be provided in particular on the one hand due to situating the dispensing opening adjacent to the bottom side, and on the other hand, situating the dispensing opening at a distance from the front outer edge, i.e., recessing the dispensing opening with respect to the front outer edge in the proximal direction. The sealing compound may be dispensed onto the substrate via the dispensing opening during use, and immediately thereafter on the one hand smoothing of the dispensed sealing compound via the front outer edge is made possible, and on the other hand, via the left and right outer edges situated on the laterally protruding blade sections it may be ensured that adjacent surface regions of the substrate are not acted on by the sealing compound.

In particular for the application position described above, when the applicator is placed on a suitable substrate in the area of the dispensing opening, a space may be created which is filled with the sealing compound being dispensed during dispensing of the sealing compound on the substrate, to allow reliable smoothing of the dispensed sealing compound in particular via the front sealing edge.

The beveled design of the blade sections is also particularly advantageous, and makes it possible to provide the outer edges. The beveled design of the blade section is selected in such a way that the blade sections are tapered in the sectional view due to the beveling, with the tip representing the outer edge in the sectional view. In addition, the outer edges all lie in one plane. This shape of the outer edges allows a particularly clean, neat application appearance. The front outer edge may allow particularly good smoothing of the dispensed sealing compound, and the left and right outer edges may allow particularly effective removal of sealing compound from the adjacent surface regions of the substrate.

The applicator is preferably made of a plastic material. An elastomer, for example a thermoplastic elastomer, is conceivable here, which with a suitable design of the applicator on the one hand may provide good results in the smoothing of sealing compound, in particular by means of a suitable rigidity of the front outer edge. On the other hand, the left and right outer edges may have a flexible design to allow effective removal of sealing compound from the adjacent surface regions of the substrate. Of course, other plastic materials are also conceivable as an alternative. For example, the applicator may be made of a polymer material such as a polyethylene (PE) or a polypropylene (PP). Alternatively, production of the applicator from various plastic materials is conceivable, wherein the materials may preferably have different properties, in particular in order to provide a front outer edge and/or a left and a right outer edge having the properties described above.

In principle, all compositions known to those skilled in the art, for example from the handicraft or do-it-yourself sectors, and in particular that are suitable for sealing joints between components in the sanitary sector or similar fields of application, are suited as sealing compounds that may be used according to the invention. These may cure under the action of moisture in the air, and include, for example, sealing compounds containing a silicone and/or a prepolymer that bears silyl groups. For the sealing compounds based on silyl-terminated prepolymers, those containing prepolymers having a polyurethane or polyoxyalkylene backbone, in particular a polypropylene glycol backbone, are particularly suited.

Sealing compounds may likewise be used in the method according to the invention which cure by evaporation of a solvent, in particular water. These include, for example, sealing compounds that contain an acrylate in the form of an aqueous dispersion, for example.

Compositions that are based on thermoplastic polymers and applied in the molten state to the treated component, or that are heated and calendered on, are likewise usable as sealing compounds within the meaning of the present invention. Suitable thermoplastic polymers are EPDM, PIB, EVA rubber or butyl rubber, TPO or PVC, polyethylene, polyester, polyurethane, or mixtures thereof.

The applicator according to the invention is suited in particular for dispensing a sealing compound onto a substrate. However, the applicator is particularly suited for dispensing a second sealing compound onto a first sealing compound that is already present. For example, joints that are provided with sealing compound, such as those known from the sanitary sector, for example, become unsightly over time and/or become cracked and/or brittle and/or lose the flank adhesion. Many of these problems may result in leaks, so that for example water and dirt may infiltrate into the sealing compound provided in the joint and provide a breeding ground for pathogens and/or bacteria and/or fungi. By use of an applicator according to the invention, in the described preferred procedure a new layer of sealing compound may be applied to the sealing compound that is already present, so that the existing sealing compound is thus coated with the new sealing compound in the sense of renewal of the surface.

In one advantageous refinement of the invention, the stated distance between the dispensing opening of the applicator and the front outer edge is in the range of 1 mm to 3 mm, preferably in the longitudinal extension of the applicator. The dispensing opening is accordingly recessed from the closest region of the front outer edge in a range of 1 mm to 3 mm. The distance is particularly preferably in a range of 1.5 mm to 2.5 mm. A particularly good application appearance is made possible by such a distance. Due to the distance, it may also be ensured that on the one hand sufficient new sealing compound is applied to completely cover the old joint, but on the other hand an excessive amount of new sealing compound is not used.

It is also particularly advantageous to use a dosing opening having a diameter in the range of 1 mm to 3 mm. The diameter is particularly preferably in a range of 1.5 mm to 2.5 mm. Alternatively or in addition to the distance described above, it may be ensured by the diameter in the described preferred range that on the one hand sufficient new sealing compound is applied to completely cover the old joint, but on the other hand an excessive amount of new sealing compound is not used.

Another advantage is the design of the beveling of the blade sections of the applicator, preferably also on their outer sides, in such a way that a right inner edge is provided on the right blade section, a left inner edge is provided on the left blade section, and a front inner edge that joins the right inner edge and the left outer edge is provided on the front blade section.

It has also proven to be particularly advantageous when the inner edges lie in the plane of the top side of the applicator, which may in particular facilitate simple manufacture of the applicator.

Another advantage is the use of a concavely curved front outer edge. A particularly good formation of the dispensed sealing compound may be enabled as the result of a concavely curved area. In particular for the procedure described above, within the meaning of renewal, the concave design may enable a particularly good coating of the existing sealing compound. To this end, the front outer edge preferably has a radius in a range of 6 mm to 50 mm. The radius is particularly preferably in a range of 10 mm to 30 mm. The front outer edge is preferably a circular arc having a length in the range of 3 mm to 12 mm, particularly preferably in a range of 6 mm to 10 mm. Alternatively, the form of the front outer edge in the shape of an elliptical arc is of course conceivable.

Of course, other alternative designs of the front outer edge are also conceivable. Thus, it may be meaningful in particular to use a front outer edge that joins the left and the right outer edges linearly and/or in the form of a straight line.

In all cases, however, it has proven to be meaningful to use a front outer edge that joins the left outer edge and the right outer edge and which is preferably in alignment with neither the left outer edge nor the right outer edge. The front outer edge is particularly preferably angled with respect to its two adjacent outer edges in such a way that the transition between the front outer edge and the left outer edge and the right outer edge, respectively, is provided in each case by a tip.

In one advantageous refinement, the right outer edge and the left outer edge extend at an angle with respect to one another which is preferably less than 90°. The angle is particularly preferably in the range of 70° to 88°.

In one refinement of the invention, it is advantageous to provide the applicator with a feed opening in order to feed the sealing compound from the container, the feed opening being enclosed by a lower edge, and the left and right blade sections preferably protruding beyond the level of the lower edge in the proximal direction. In one advantageous refinement, the left and right blade sections taper in the proximal direction.

A further basic concept of the present invention is the provision of an application device having a proximal side and a distal side situated opposite from the proximal side, and having a container on the proximal side that contains a sealing compound to be applied, and an above-described applicator, for applying a sealing compound to a substrate, on the distal side. According to the invention, it is provided that the applicator has at least one dispensing opening for applying the sealing compound to a substrate, and a protruding blade for smoothing the applied sealing compound. According to the invention, the blade of the applicator is also designed in such a way that it has a top side and a bottom side, the bottom side being situated adjacent to the dispensing opening, and the blade having a right blade section and a left blade section situated opposite from the right blade section, and the right blade section and the left blade section laterally protruding, and the blade also having a front blade section that protrudes in the distal direction. Furthermore, it is provided according to the invention that the blade sections are preferably beveled on their outer sides, at least in areas, in such a way that a right outer edge is provided on the right blade section, a left outer edge is provided on the left blade section, and a front outer edge that joins the right outer edge and the left outer edge is provided on the front blade section, the outer edges lying in the plane of the bottom side, and the dispensing opening, as described above, being situated at a distance from the front outer edge.

The applicator may be designed as described above, and may have all the described advantageous refinements. In particular sealing compounds described above are suitable for use as sealing compounds.

The container may be any desired container for holding the sealing compound. Particularly suited is a container made of a plastic material, which is designed in such a way and has a wall such that the user may manually press the container in order to dispense the sealing compound. The container may in particular have a tube-like design. In all cases, it has proven advantageous for the container to have a rigid container shoulder with a container neck on the distal side so that the applicator may be securely fastened. However, the container may also be designed as a cartridge, known in the prior art, wherein the sealing compound is preferably dispensed by means of a cartridge gun known to those skilled in the art. Another variant is a design of the container as a pressure container, known to those skilled in the art. Known pressure containers are usually made of a rigid plastic material or a metallic material, the sealing compound inside the container being pressurized by suitable means. A valve that is activated for dispensing the sealing compound is provided on the distal side of the container.

In one advantageous refinement, the applicator and the container have corresponding components for providing a means for defining the position of the applicator relative to the container, in order to prevent twisting of the applicator relative to the container and thus secure the position of the applicator relative to the container. These means may be provided in particular via a key-lock principle. It is conceivable in particular to provide a first part of the means on the applicator, and a corresponding part of the means on the container. In the installed state, both parts of the means engage with one another, thus providing positional definition in the form of anti-twist protection. For example, the container may have indentations into which protruding areas of the applicator may engage in the installed state. Alternatively, it is conceivable to provide protruding cams on the container which engage with corresponding recesses in the applicator in the installed state. Of course, similar designs are also conceivable.

A further basic concept of the present invention is a method for applying a sealing compound, using an above-described applicator according to the invention or an above-described application device according to the invention, comprising a container and in particular an applicator according to the invention.

In one advantageous refinement, the method is used for applying a sealing compound for a joint, the joint already having a first sealing compound, and a further sealing compound being applied to the first sealing compound by means of the applicator and/or the application device.

One preferred embodiment of an applicator according to the invention and of an application device according to the invention is depicted in the appended figures, which show the following:

DETAILED DESCRIPTION

Figure 1:
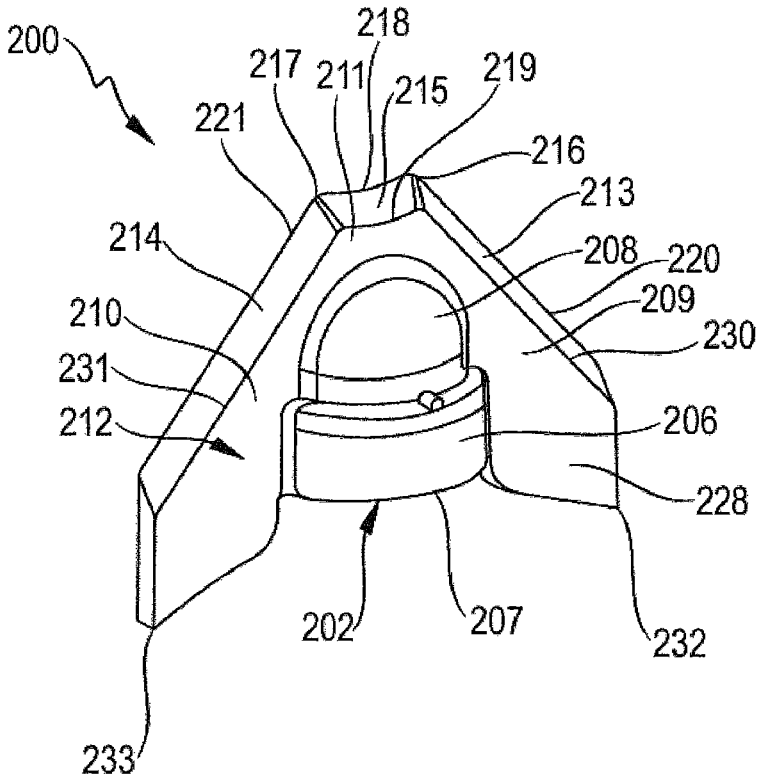
FIG. 1 shows a perspective view of an applicator according to the invention.

FIG. 1 shows a perspective view of an applicator 200 according to the invention for applying a sealant to a substrate. The applicator 200 shown is used for applying a silicone as sealant, an elongated joint between two tiles being provided as the substrate, and the tiles being situated at a right angle with respect to one another.

The applicator 200 on its proximal side has a hollow cylindrical section 206 which is delimited in the distal direction by a lower edge 207. The lower edge 207 encloses a feed opening 202, concealed in FIG. 1, that is used for feeding the sealant from a container, not shown. In addition, the hollow cylindrical section 206 has a connecting means, not discernible in FIG. 1, via which the applicator 200 may be connected to the container, not shown. The hollow cylindrical section 206 is adjoined in the distal direction by a dome-shaped projection 208. In addition, the applicator has a protruding blade 212 in particular for smoothing the applied sealing compound, the protruding blade being integrally formed onto the dome-shaped projection 208 and onto the hollow cylindrical section 206. The basic shape of the blade 212 is essentially triangular or chevron-like or V-shaped, with the blade 212 widening from a narrow side in the direction of the proximal side.

The blade 212 has a right blade section 209 on one side of the dome-like projection 208 and the hollow cylindrical section 206, and has a left blade section 210 situated opposite from the right blade section 209. Both blade sections 209, 210 lie in a plane, and in each case protrude laterally from the dome-like projection 208 and the hollow cylindrical section 206. In addition, the blade 212 has a front blade section 211 which joins the right blade section 209 and the left section 210, and which is integrally formed onto the distal end of the dome-shaped projection 208. The blade sections 209, 210, 211 are designed and situated relative to one another in such a way that on a top side 218 of the blade 212 they lie in a plane. At its lateral outer area the right blade section 209 has a chamfer-like bevel 213 that extends at a 45° angle in the direction of a bottom side, not discernible in FIG. 1 and extending in parallel to the top side 218, in such a way that the surface of the right blade section 209 is larger on the bottom side than on the top side 228. The transition from the plane of the right blade section 209 on the top side 228 to the bevel 213 forms a linear right inner edge 230. The bevel 213 ultimately ends at a right outer edge 220 that is situated opposite from the right inner edge 230 and extends in parallel to the inner edge 230 on the bottom side of the right blade section 209. The left blade section 210 has a corresponding design, and has a bevel 214; in turn, a linear left inner edge 231 is formed at the transition from the plane of the left blade section 210 on the top side 228 to the bevel 213. Here as well, corresponding to the above description of the right blade section 209, a left outer edge 221 is provided that is situated opposite from the left inner edge 231 and extends in parallel to the inner edge 231. The two bevels 213, 214 are designed as planar surfaces. Lastly, the front blade section 211 is also provided with a bevel 215 which is designed according to the above description, and which provides a front inner edge 219 and a front outer edge 218 on the front blade section 211. The front inner edge 219 in turns joins the right inner edge 230 to the left inner edge 231. In addition, the front outer edge 218 joins the right outer edge 220 to the left outer edge 221. It should also be noted that the bevel 215, in contrast to the bevels 213, 214, is curved and has a curvature such that the front inner edge 219 as well as the front outer edge 218 are concavely curved. In the present exemplary embodiment shown, this is understood to mean a curvature of the outer edges 218, 219 in the proximal direction.

In particular due to the above-described basic shape of the blade 212, which is essentially triangular or chevron-like, in conjunction with the described design of the bevels 213, 214, in particular the right outer edge 220 and the left outer edge 221 extend at an angle with respect to one another, the vertex of the angle being situated in the distal direction, so that the distance between the outer edges increases in the proximal direction. The angle is preferably less than 90°; in the exemplary embodiment shown, an angle of 85° has proven advantageous. In other respects, the same also applies for the right inner edge 230 and the left inner edge 231.

Due to the concave design of the front outer edge 218 in particular, a tip 216 that protrudes in the distal direction is provided in the transition from the front outer edge 218 to the right outer edge 220. Correspondingly, a further tip 217 which likewise protrudes in the distal direction is provided in the transition from the front outer edge 218 to the left outer edge 221. On the opposite side of the applicator 200, the right blade section 209 and the left blade section 210 protrude in the proximal direction beyond the level of the lower edge 207, and open into a tip 232 or tip 233, respectively, that is radially spaced apart from the lower edge 207.

The applicator 200 also has a dispensing opening for dispensing the sealing compound onto a substrate, the dispensing opening being situated on the end-face side of the dome-shaped projection 208 pointing in the distal direction, but in FIG. 1 being concealed by the front blade section 208. The dispensing opening is situated concentrically with respect to the feed opening 202.

Figure 2:
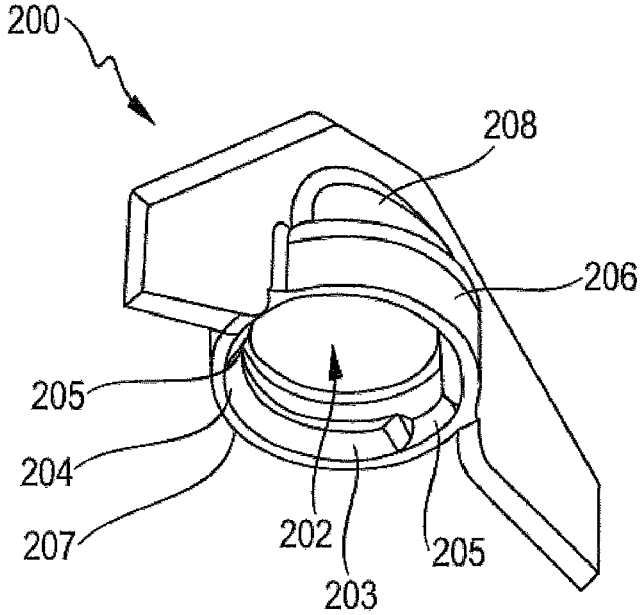
FIG. 2 shows another perspective view of the applicator from FIG. 1.

FIG. 2 shows another perspective view of the applicator 200 from FIG. 1. The feed opening 202 is clearly apparent here, which allows feeding of the sealing compound into the inner areas of the applicator 200, which are enclosed in particular by the hollow cylindrical section 206 and the dome-shaped projection 208. The subsequent figures will now be discussed in greater detail. The feed opening 202, which in the present exemplary embodiment shown is essentially circular, is enclosed in particular by the lower edge 207 as described above. A collar 203, which protrudes into the feed opening 202 in the radial direction and with which the applicator may be fastened to a container, is integrally formed onto the lower edge 207. In the embodiment shown, the applicator 200 is snapped onto the neck of a container; the areas of the collar 203 pointing in the radial direction are provided with a chamfer 204 or a bevel to ensure easier assembly. The collar 203 is also interrupted at each of two diametrically opposing areas by a recess 205. These recesses 205, as described in greater detail below, are used as a means for defining the position of the applicator 200 relative to the container in order to prevent twisting of the applicator 200 relative to the container and to thus secure the position of the applicator 200 relative to the container.

Figure 3:
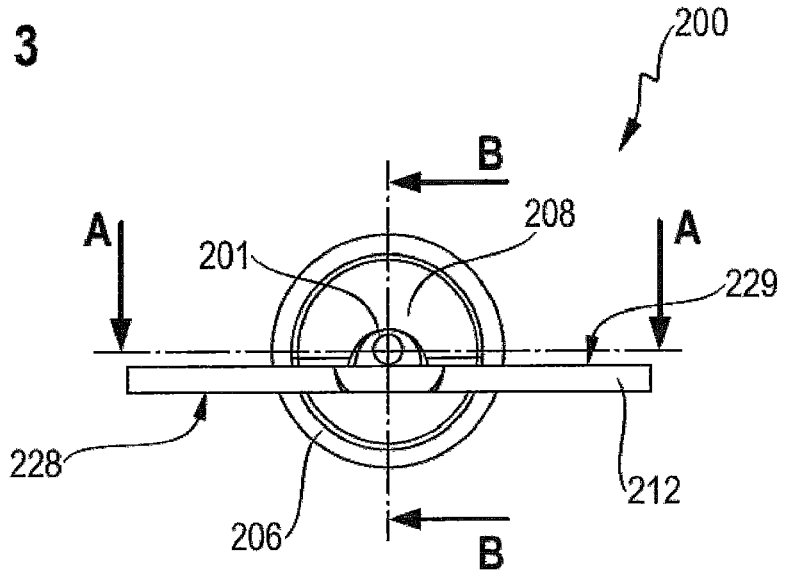
FIG. 3 shows a front view of the applicator from FIG. 1.

FIG. 3 shows a front view of the applicator from FIG. 1; the above-described dispensing opening 201, which is situated concentrically with respect to the feed opening 202, is apparent here. It is also illustrated in FIG. 3 that the top side 228 of the blade 212 has a flat plane and is situated on the opposite side of the blade, above the described bottom side 229 of the blade 212. The bottom side 229 is likewise a flat plane which also extends in parallel to the top side 228. In addition, the dispensing opening 201 is situated directly adjacent to the bottom side 229 of the blade 212, on the end-face side of the dome-shaped projection 208 pointing in the distal direction. In the proximal direction, the dome-shaped projection 208 is in turn adjoined by the hollow cylindrical section 206, whose outer diameter is larger than the region of the dome-shaped projection 208 having the largest outer diameter.

Figure 4:
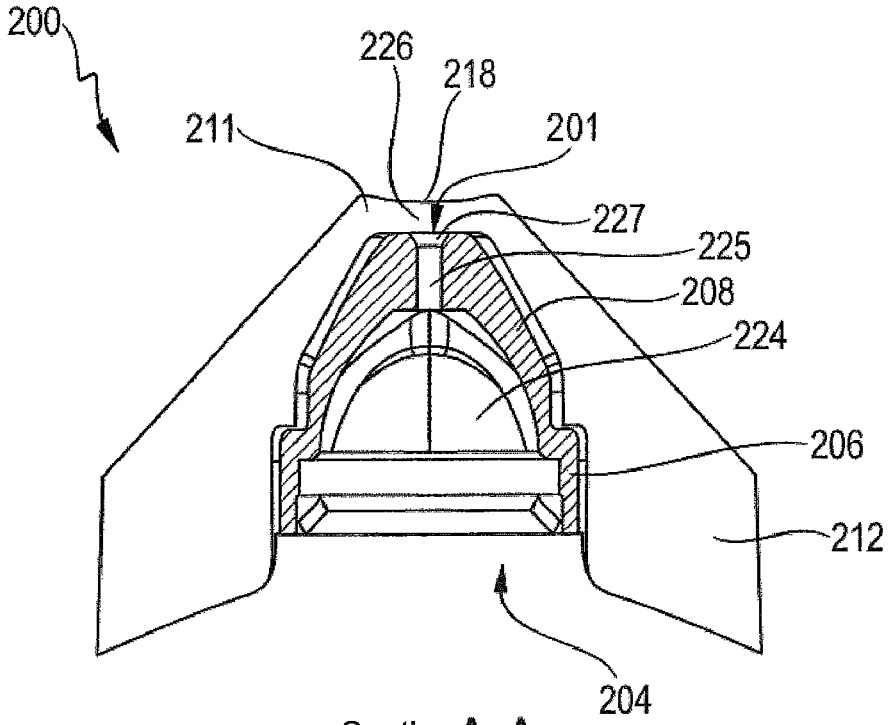
FIG. 4 shows a sectional view of the applicator from FIG. 3 through the section line A-A.

FIG. 4 shows a sectional view of the applicator 200 from FIG. 3, through the section line A-A. It is apparent in the sectional view that the front blade section 211 protrudes in the distal direction beyond the level of the end-face side of the dome-shaped projection 208 pointing in the distal direction. Consequently, the dispensing opening 201 situated on the end-face side is situated at a distance from the front outer edge 218, and is thus recessed in the proximal direction with respect to the outer edge 218. The distance between the dispensing opening 201 and the closest point on the front outer edge 218 is preferably in the range of 1 mm to 3 mm, and in the exemplary embodiment shown is 2 mm. As mentioned above, the sealing compound to be dispensed is fed to the applicator 200 via the feed opening 202, the feed opening 202 opening up the path to an interior 224 that is enclosed on the one hand by the hollow cylindrical section 206, and on the other hand by the dome-shaped projection 208 in the direction of the distal side. This interior 224 has a cupola-shaped design in the distal direction, and at that location opens into a cylindrical feed channel 225 which in turn opens into the dispensing opening 201. It is to be noted that the feed channel 225 is provided with a conical section 227 in the distal end area which is designed in such a way that the diameter of the feed channel 225 increases toward the dispensing opening 201. This conical section 227 may facilitate in particular the introduction of a closure means for the feed channel 225; the closure means may be situated on a cover cap, for example.

Figure 5:
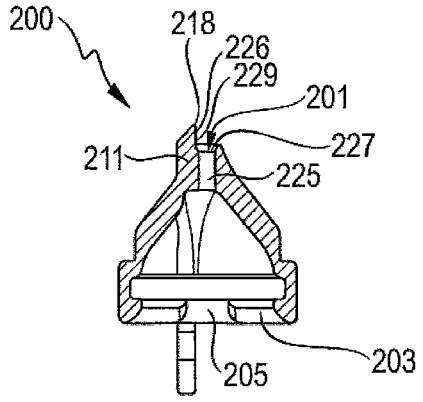
FIG. 5 shows a sectional view of the applicator from FIG. 3 through the section line B-B.

FIG. 5 shows a sectional view of the applicator from FIG. 3 through the section line B-B, and illustrates once again the position of the dispensing opening 201 with respect to the front outer edge 218. The distance between the front outer edge 218 and the dispensing opening 201 is clearly apparent. It is also clear that the dispensing opening 201 is situated directly adjacent to the bottom side 229 of the front blade section 211, and a blade wall section 226 extends in the distal direction from the level of the dispensing opening 201 to the front outer edge 218. Also clearly apparent in FIG. 5 is the collar 203 for mounting the applicator 200 on a container; a recess 205 is also depicted which is used as a means for defining the position of the applicator 200 relative to the container.

Figure 6:
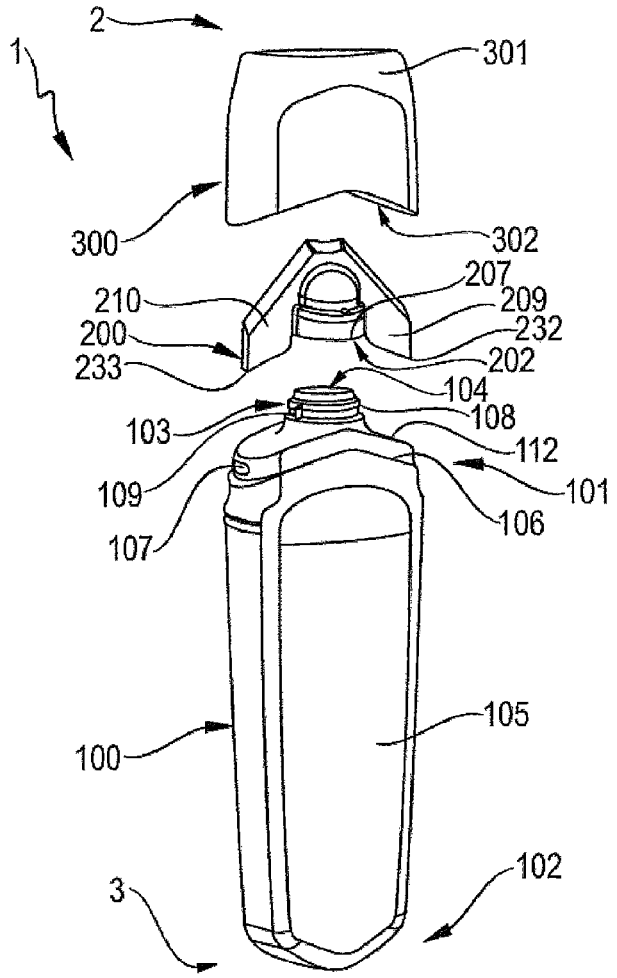
FIG. 6 shows a perspective view of an application device according to the invention which has the applicator from FIG. 1.

FIG. 6 shows a perspective view of an application device 1 according to the invention, which has the applicator 200 from FIG. 1 and a container 100 containing the sealing compound to be dispensed. A cap 300 with which the applicator may be covered and closed is also provided. The application device 1 thus represents an assembly comprising the container 100 and the applicator 200, with a cap 300 as an optional further fitting. An exploded view of the assembly is apparent in FIG. 6; i.e., the components of the assembly are depicted in the uninstalled state. The applicator 200 and the optional cap 300 are provided on a distal side 2 of the application device, while the container 100 is provided on a proximal side 2. The container 100 has a bottom side 102 that points in the direction of the proximal side 3, and together with its container wall 105, which encloses an interior for holding the sealing compound, extends in the direction of the distal side 2. At that location the container has a step 106 which forms a section that is set back with respect to the adjoining surface of the container wall 105. Depressions 107 are provided here on two opposite sides, and have a design corresponding to protruding areas in the cap 300 and allow a detachable connection technique between the container 100 and the cap 300. However, a connection on the cap 300 and the container 100 may also be established by means of other corresponding connecting sections. Lastly, the container wall 105 at the set-back section opens into a shoulder area 112 having a centrally situated container neck with an essentially hollow cylindrical design. On its end pointing in the distal direction, the container neck has an opening for dispensing the sealing compound, and is used as a mounting area 103 for the applicator 200. For mounting, the protruding neck is inserted into the feed opening 202 of the applicator 200. To allow secure fastening between the two components, a circumferential projection 108 is provided on the neck, which in the mounted state of the applicator 200 engages behind the above-described collar 203 of the applicator. In addition, two oppositely situated protruding sections 109 are formed on the outer wall of the neck, and in the mounted state of the applicator 200 engage with the above-mentioned recesses 205 in order to provide a means for position fixing. In the mounted state of the applicator 200, the areas of the right blade section 209 and of the left blade section 210 that protrude beyond the level of the lower edge 207 in the direction of the proximal side 3 abut with their end-face edges against the shoulder area 212, and have a design that corresponds to the shape of the shoulder area 212. In the mounted state of the applicator 200, the end sections 232 and 233 are each situated in the immediate vicinity of the respective transition area from the corresponding lateral end section of the shoulder area 212 and the corresponding area of the above-mentioned set-back section. The cap 300 in turn has a cap outer side 301 and a cap opening 302, and is designed in such a way that in the mounted state it is able to accommodate and cover the applicator 200.

Figure 7:
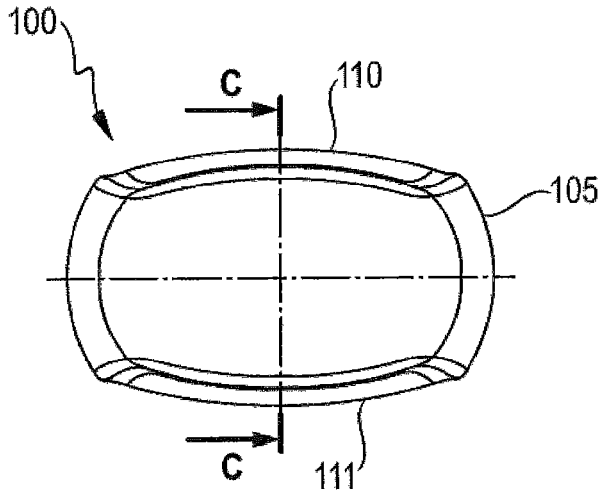
FIG. 7 shows a rear view of the application device from FIG. 6.

FIG. 7 shows a view of the application device 1 from FIG. 6 on the bottom side 102 of the container 100. The container wall 105 on a front side is provided with a front activating surface 110, and on an oppositely situated rear side is provided with a rear activating surface 111. Both activating surfaces 110, 111 are designed in such a way that an application of force by the hand of the user on the activating surfaces 110, 111 in the mutually facing direction allows a reduction in the volume of the interior bordered by the container wall 105 to allow dispensing of the sealing compound via the opening 104, the feed opening 202, and ultimately the dispensing opening 201 of the applicator 200. The two activating surfaces 110, 111 may have a design, for example, that is flexible, or thin-walled at least in areas, for example to allow deformation.

Figure 8:
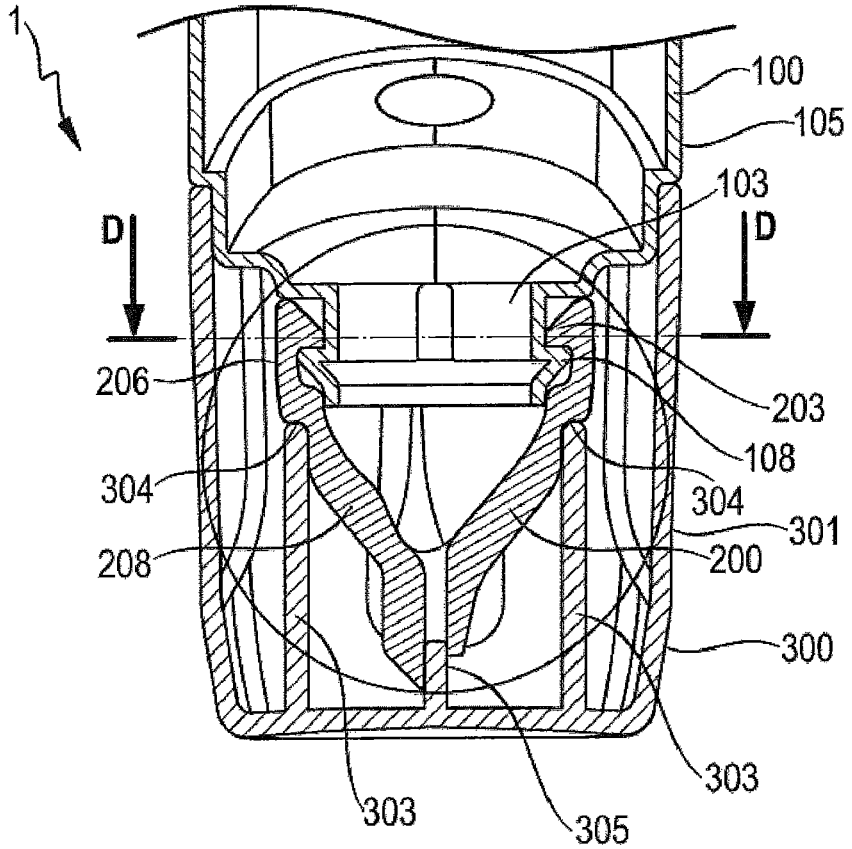
FIG. 8 shows a detail of a sectional side view through the section line C-C of the application device from FIG. 7.

FIG. 8 shows a detail of a sectional side view through the section line C-C of the application device 1 from FIG. 7, in which the applicator 200 and the cap 300 are both mounted on the container 100. The cap 300 is designed and mounted in such a way that the cap outer side 301 is aligned with the container wall 105. The interior enclosed by the cap outer side 301, and the covered applicator 200 are visible in the sectional view. In this position of the components of the assembly relative to one another, the collar 203 and the circumferential projection 108, as a corresponding connecting means for the container 100 and applicator 200, are engaged with one another and ensure a secure connection of the two components. The cap 300 has support sections 303 which protrude into the interior and which are placed on protruding support points 304 on the end-face sides of the hollow cylindrical section 206, which are situated adjacent to the dome-shaped projection 208. In addition, the cap 300 has a pin 305 that protrudes into the interior, and which is designed and arranged corresponding to the opening 201 in the applicator 200 and is used as a closure means. In the mounted state of the cap 300, the pin 305 protrudes, at least in areas, through the opening 201 into the feed channel 225, and may thus prevent the sealing compound in the feed channel 225 and/or in the area of the dispensing opening 201 from drying out. To facilitate insertion of the pin 305, the feed channel 225 has a conical section 227 in the upper area, as discussed above.

Figure 9:
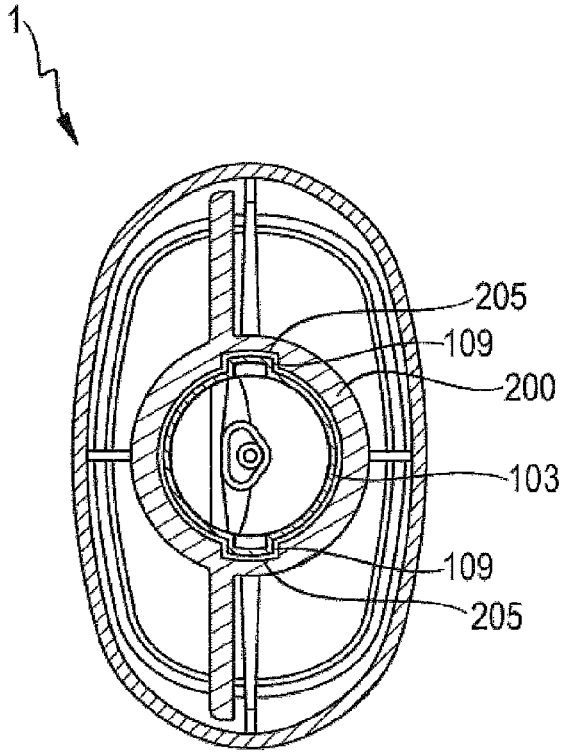
FIG. 9 shows a sectional side view through the section line D-D of the application device from FIG. 8.

FIG. 9 shows a sectional side view through the section line D-D of the application device 1 from FIG. 8, and provides a view into the corresponding components which provide the means for defining the position of the applicator 200 relative to the container 100. The sections 109 laterally protruding on both sides from the neck of the container engage with the receptacles 205 in the mounted state of the applicator. Twisting of the applicator 200 relative to the container 100 is then no longer possible. This offers many advantages in particular for use of the application device. For example, the user may exert force on the container 100 as described above in order to apply sealing compound, and does not have to ensure that the position of the applicator 200 with respect to the container 100 is maintained, since the above-described means precludes unwanted twisting. Of course, alternative designs are also conceivable here.

The use of a described applicator 200, in particular as a component of a described assembly, namely, by utilizing the described application device 1 for applying a sealing compound to a substrate, is particularly suited, for example, for sealing a joint in the sanitary sector. Of course, other uses are also conceivable. In all cases, such guiding of the applicator 200 is provided in which the bottom side 229 and the application opening 201 face the joint or the corresponding substrate to be provided with the sealing compound. The sealing compound may be dispensed, as described above, by exerting pressure on a container 100. The applicator 200 is subsequently guided in such a way that the dispensed sealing compound is smoothed, in particular by means of the front application edge 218.

The use is suited in particular for fields of application in which the joint is defined by two surface regions that are situated at an angle with respect to one another, for example two tiles situated at a right angle. In this case, the right application edge 220 and the left application edge 221 may be guided along the surface of the tiles during dispensing of the sealing compound and during smoothing of the surface of the sealing compound by means of the front application edge 218, for example to remove sealing compound from these areas. Alternatively, in another field of application, with a suitable surface the applicator 200 may be guided via the two tips 216, 217, and the dispensed sealing compound may once again be smoothed by means of the front outer edge 218.

The applicator 200, in particular as a component of a described assembly, namely, by using the described application device 1, is particularly suited for applying a second sealing compound to a first sealing compound that is already present in order to apply a new layer of second sealing compound to the first sealing compound already present. In this way, the first sealing compound may be coated with a layer of second sealing compound, thus achieving a renewal of the surface.

LIST OF REFERENCE NUMERALS

| | | | |
|---|---|---|---|
| 1 | application device | 212 | blade |
| 2 | distal side | 213 | bevel |
| 3 | proximal side | 214 | bevel |
| 100 | container | 215 | bevel |
| 101 | top side | 216 | tip |
| 102 | bottom side | 217 | tip |
| 103 | mounting area | 218 | front outer edge |
| 104 | opening | 219 | front inner edge |
| 105 | container wall | 220 | right outer edge |
| 106 | step | 221 | left outer edge |
| 107 | depression | 223 | upper end |
| 108 | projection | 224 | interior |
| 109 | protruding section | 225 | feed channel |
| 110 | front activating surface | 226 | blade wall section |
| 111 | rear activating surface | 227 | conical section |
| 112 | shoulder area | 228 | top side |
| 200 | applicator | 229 | bottom side |
| 201 | dispensing opening | 230 | right inner edge |
| 202 | feed opening | 231 | left inner edge |
| 203 | collar | 232 | right end section |
| 204 | chamfer | 233 | left end section |
| 205 | recess | 300 | cap |
| 206 | hollow cylindrical section | 301 | cap outer side |
| 207 | lower edge | 302 | cap opening |
| 208 | dome-shaped projection | 303 | support section |
| 209 | right blade section | 304 | support point |
| 210 | left blade section | 305 | pin |
| 211 | front blade section | 301 | cap outer side |

The invention claimed is:

1. An applicator having a feed opening, a dispensing opening situated opposite from the feed opening and defining a center axis and a plane through the center axis, the applicator for applying a sealing compound to a substrate, wherein the applicator has a protruding blade for smoothing the applied sealing compound, wherein the blade has a top side and a bottom side, the bottom side being situated adjacent to the dispensing opening, wherein the blade has a right blade section and a left blade section situated opposite from the right blade section, the right blade section and the left blade section protruding laterally, and the blade also having a front blade section that protrudes in the distal direction, wherein the blade sections are parallel to the center axis, wherein the blade sections are beveled in such a way that a right outer edge is provided on the right blade section, a left outer edge is provided on the left blade section, and a front outer edge that joins the right outer edge and the left outer edge is provided on the front blade section, wherein the outer edges lie in the plane of the bottom side, and the dispensing opening is spaced from the front outer edge.

2. The applicator according to claim 1, wherein the spacing between the dispensing opening of the applicator and the front outer edge is in the range of 1-3 mm.

3. The applicator according to claim 1, wherein the beveling of the blade sections of the applicator is further designed in such a way that a right inner edge is also provided on the right blade section, a left inner edge is provided on the left blade section, and a front inner edge that joins the right inner edge and the left outer edge is provided on the front blade section.

4. The applicator according to claim 3, wherein the inner edges lie in the plane of the top side.

5. The applicator according to claim 1, wherein the front outer edge is concavely curved.

6. The applicator according to claim 1, wherein the right outer edge and the left outer edge are situated at an angle with respect to one another in the range of 70° to 88°.

7. The applicator according to claim 1, wherein the applicator has a feed opening that is enclosed by a lower edge, the blade sections protruding beyond the level of the lower edge.

8. An application device having a proximal side and a distal side situated opposite from the proximal side, and having a container on the proximal side that contains a sealing compound to be applied, and an applicator having a feed opening, a dispensing opening situated opposite from the feed opening and defining a center axis and a plane through the center axis, the applicator for applying a sealing compound to a substrate, wherein the applicator has a protruding blade for smoothing the applied sealing compound, wherein the blade has a top side and a bottom side, the bottom side being situated adjacent to the dispensing opening, wherein the blade has a right blade section and a left blade section situated opposite from the right blade section, the right blade section and the left blade section protruding laterally, and the blade also having a front blade section that protrudes in the distal direction, wherein the blade sections are parallel to the center axis, wherein the blade sections are beveled in such a way that a right outer edge is provided on the right blade section, a left outer edge is provided on the left blade section, and a front outer edge that joins the right outer edge and the left outer edge is provided on the front blade section, wherein the outer edges lie in the plane of the bottom side, and the dispensing opening is spaced from the front outer edge.

9. An applicator for applying a sealing compound to a substrate, comprising:

a hollow cylindrical section delimited by a lower edge on a proximal side of the applicator, the lower edge enclosing a feed opening;

a dome shaped projection on a distal side of the applicator, the projection joined to the hollow cylindrical section, the dome shaped projection defining a dispensing opening fluidly connected to the feed opening;

a blade for smoothing the applied sealing compound, including a top side and a bottom side, the bottom side being situated adjacent to the dispensing opening, a right blade section and a left blade section opposite from the right blade section, the right blade section and the left blade section protruding laterally from the dome shaped projection, and a front blade section protruding from the dome shaped projection in the distal direction.

10. The applicator according to claim 9, wherein the blade sections are beveled in such a way that a right outer edge is provided on the right blade section, a left outer edge is provided on the left blade section, and a front outer edge that joins the right outer edge and the left outer edge is provided on the front blade section, wherein the outer edges lie in the plane of the bottom side, and the dispensing opening is spaced from the front outer edge.

11. The applicator according to claim 9, wherein the front blade section comprises two, spaced distally projecting tips connected by a concave, proximally recessed front outer edge.

* * * * *